United States Patent [19]

Simmen

[11] 4,197,946

[45] Apr. 15, 1980

[54] DEVICE FOR PACKING LIQUID CRYSTAL CELLS

[75] Inventor: Armin Simmen, Schinznach-Dorf, Switzerland

[73] Assignee: BBC Brown Boveri & Company, Limited, Baden, Switzerland

[21] Appl. No.: 952,157

[22] Filed: Oct. 17, 1978

[30] Foreign Application Priority Data

Nov. 22, 1977 [CH] Switzerland ..... 14236/77

[51] Int. Cl.[2] ..... B65D 1/36; B65D 85/62

[52] U.S. Cl. ..... 206/332; 206/518; 229/2.5 R

[58] Field of Search ..... 206/332, 518; 229/2.5 R

[56] References Cited

U.S. PATENT DOCUMENTS

| | | | |
|---|---|---|---|
| 3,469,686 | 9/1969 | Gutsche et al. | 206/332 |
| 4,057,142 | 11/1977 | Lechner et al. | 206/332 |

*Primary Examiner*—William T. Dixson, Jr.

*Attorney, Agent, or Firm*—Oblon, Fisher, Spivak, McClelland & Maier

[57] ABSTRACT

A device for packing liquid crystal cells in at least one horizontal plane extending parallel to the fronts and backs of the cells, which includes at least one cover and at least one pack provided with depressions within which the cells are received, wherein an additional pack is provided as a cover having the same dimensions of the other packs, with the additional cover pack likewise having depressions similarly dimensioned such that the cells bear at most with their front and back edges and/or corners bounded by the depressions of the packs.

4 Claims, 5 Drawing Figures

DEVICE FOR PACKING LIQUID CRYSTAL CELLS

BACKGROUND OF THE INVENTION

1. Field of the Invention

The present invention relates to a device for packing liquid crystal cells in at least one horizontal plane extending parallel to the fronts and backs of the cells, comprising at least one cover and at least one packing provided with depressions and consisting of a material having substantially the same thickness as the cells.

2. Description of the Prior Art

When packing liquid crystal cells, it has hitherto been usual to accommodate the liquid crystal cells in the depressions of a blister pack consisting of highly transparent hard PVC of substantially the same thickness such that the fronts and backs of the cells lay in the same horizontal plane. Each blister pack provided with a horizontal layer of cells was then closed with an aluminium foil coated with heat-sealing lacquer. A plurality of sealed blister packs were stacked in a cardboard box, and the filled box was made ready for dispatch by adhesion.

Since liquid-crystal cells are each coated with a polarizer at the front and at the back and possibly also with a reflector at the back, and since these coatings can be extremely easily damaged by mechanical actions, damage to the cells was often unavoidable because of the shaking occurring during transport and the large bearing surface of the polarizers or of the reflector, if the packing somehow was made to lie upside down with the sealed cover downwards. In addition, such sealed packings were difficult to open so that some cells might possibly fall out.

It has likewise been usual to accommodate the liquid crystal cells on edge in a comb groove in an expanded polystyrene box, to close the box with an expanded polystyrene cover, and to fix it with an adhesive tape. The shocks occurring during transport are admittedly largely taken up by the use of the soft expanded polystyrene so that the polarizers and reflectors are substantially protected from mechanical damage, but the cells are soiled by the dust rubbed off the expanded polystyrene during the transport. In addition, a difficult joining is necessary when introducing the cells into the packing and a visual check of the packed cells cannot be carried out.

SUMMARY OF THE INVENTION

Accordingly, it is therefore the object of the invention to provide a device of the above-mentioned kind in which the packed liquid crystal cells can withstand even long transport distances with much shaking without mechanical damage and in which, in addition, a visual check of the cells is possible if necessary.

This and other objects are achieved according to the invention by providing an additional packing as a cover which has the same geometrical dimensions as the packing adapted to receive the cells, and the additional packing having depressions which lie immediately above the depressions in the packing adapted to receive the cells, the depressions in the packings being so shaped that the cells rest at most with their edges and/or corners bounding the fronts and backs on the upper side of the packing adapted to receive the cells and against the under side of the additional packing adapted to cover the cells.

Such a device for packing liquid crystal cells is distinguished by the fact that damage to the polarizers provided at the front or back, or to the reflector which may be provided at the back, is impossible because contact between the cells and any rigid parts of the packing is provided only at the edges and/or corners which are protected from mechanical effects occurring during transport. In addition, this packing device only comprises a single type of packing which can be used both as a receiving packing and as a cover packing so that with two packings a horizontal layer of liquid crystal cells can be received, with three packings a stack of two layers and with n packings a stack of n-1 layers. In comparison with the packings hitherto usual, therefore, not only can more cells be accommodated in the same space but the extraction of the cells for mounting in indicating instruments is simplified very considerably because the removal of the sealing foil is replaced by lifting off the uppermost packing and because the turning of a cell from front to back is effected by turning the whole device and lifting off the packing previously placed right at the bottom thereof.

It is advisable that, in the packing, in each depression, at least two opposite surfaces which are inclined from the top outside towards the bottom inside should be provided in an upper region and at least two opposite surfaces which are inclined from the top inside to the bottom outside should be provided in a lower region, the angle between the two surfaces being obtuse and preferably being between 90° and 170°, because in a device thus constructed each cell bears with at least two lower opposite edges against the upper chamfered surfaces of the depression in the lower packing and with at least two upper opposite edges against the lower chamfered surfaces of the depression in the packing disposed above it. With a device of such a construction, therefore, not only are the sensitive fronts and backs of the cells completely exposed but also they are fixed by the wedge action of the chamfered surfaces.

A particularly satisfactory fixing of the cells is caused if the device is so dimensioned that each region has two surfaces, the surfaces of the upper region being a mirror image of the surfaces of the lower region, and/or if the inclined surfaces of the upper and lower regions are bounded outside, at least partially, by projecting boss members.

A device in which four surfaces are provided both in the upper region and in the lower region has proved satisfactory. In this case it is particularly recommended that the surfaces of at least one region should be disposed turned through 90° about the vertical, i.e., a mirror image of the other region.

A visual check of the indicating surfaces of the cells is possible if transparent substances such as hard PVC or translucent substances such as polystyrene are provided as a material.

In order to inform the receiver of the device ready for dispatch of its contents, it is advisable to provide a recess to receive a wrapper at the surface of the packing.

In addition, in order to facilitate removal of the cells, it is advantageous to provide at least two opposite apertures at each depression.

In order to fix the device, and as security against unauthorized opening, it is advisable for the packings to be fixed in relation to one another by wrapping with a band or flexible tube.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
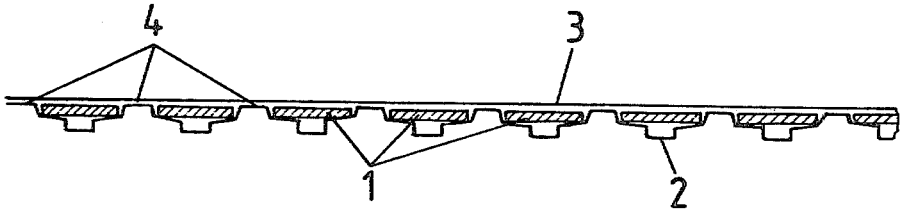
FIG. 1 is a cross-sectional view taken through a prior art device for packing liquid crystal cells.

Referring now to the drawings, wherein like reference numerals designate identical or corresponding parts throughout the several views, and more particularly to FIG. 1 thereof, it is firstly noted that the reference numeral 1 designates liquid crystal cells which are disposed horizontally, that is to say with the front and back turned upwardly and downwardly respectively, in the depressions of a blister pack 2. The pack 2 is closed by means of an aluminum foil 3 coated with hot-sealing lacquer, a hermetically sealed sealing-lacquer seam being formed by means of a suitable tool.

Figure 2:
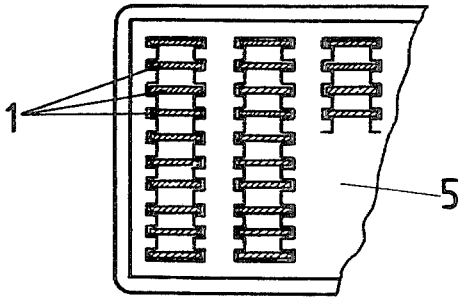
FIG. 2 is a plan view of another prior art device for packing liquid crystal cells.

In FIG. 2, the reference numeral 1 again designates liquid crystal cells which are set on edge in the comb groove of an expanded polystyrene box 5.

Figure 3A:
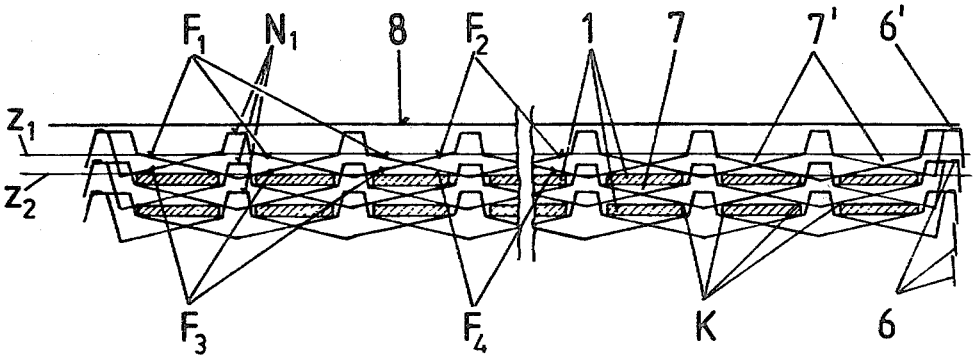
FIGS. 3*a* and 3*b* are cross-sectional views taken through specific embodiments of the device of the invention.

FIG. 3*a* represents a section through one form of embodiment of the invention, wherein rectangular liquid crystal cells are designated by the reference numeral 1 being accommodated in the depressions 7 of the blister packs 6. The empty depressions of the top blister pack 6' serving as a cover, are designated by 7'. In this pack 6', a recess is provided to receive a wrapping 8. The liquid crystal cells 1 lie with their lower edges K on the surfaces $F_1$ and $F_2$ present in the upper region $Z_1$ of each blister pack 6. The surfaces of the upper region $F_1$ are bounded towards the outside, at least partially, by projecting boss members $N_1$, as a result of which the liquid crystal cells 1 are disposed substantially non-displaceably in the pack 6 even after removal of the pack 6' above them. The surfaces $F_3$ and $F_4$ present in the lower region $Z_2$ of each blister pack rest on the upper edges of the liquid crystal cells 1.

Since all the blister packs 6, 6' are alike, the surfaces $F_1$, $F_2$, $F_3$ and $F_4$ are only designated on the top pack 6' for reasons of clarity in FIG. 3*a*. The regions $Z_1$ and $Z_2$ represented symbolically naturally appear in all the packs 6 and in addition any number of packs may be stacked one above the other. It is also possible to turn the whole stack upside-down and to remove the pack previously at the bottom, which has now taken over the function of the cover, and to remove the exposed cells of the top layer completely, after which the pack previously serving to receive the cells now merely performs the function of covering the next following layer.

The surfaces $F_1$ and $F_2$ or $F_3$ and $F_4$ are preferably at an angle of between 90° and 170° to one another so as to ensure that the cells only rest on their edges K. The dimensions of the depressions in the packs 6, 6' are naturally adapted to the dimensions of the cells 1. The thickness of the material of the packs amounts to at most a few tenths of a millimeter.

Figure 3B:
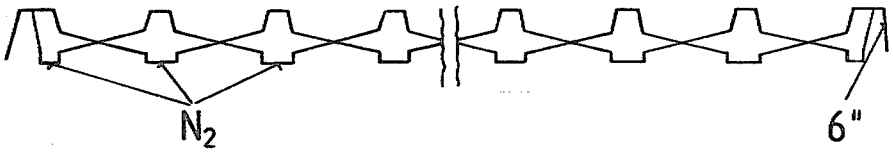

In FIG. 3*b* a further pack 6'' is illustrated which differs from the packs 6, 6' in that the surfaces of the lower region $Z_2$ are bounded by downwardly projecting boss members $N_2$. By this means, the effect is achieved that the liquid crystal cells 1, after turning upside-down a stack built up from such packs, are disposed substantially non-displaceably in the pack 6'' even after removal of the top pack.

Figure 4:
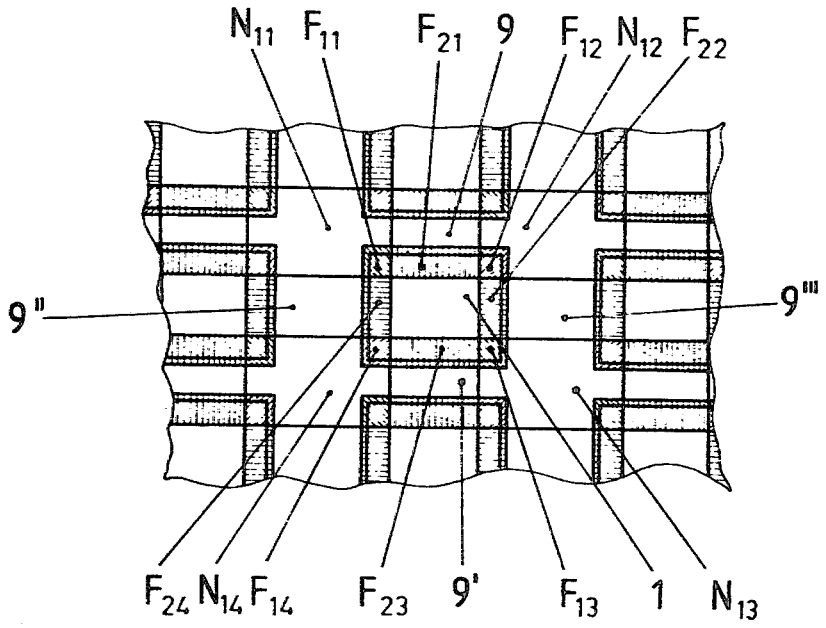
FIG. 4 is a plan view of another embodiment of the device of the invention.

In FIG. 4, a plan view is illustrated of an embodiment of the device according to the invention which has proven best in shaking and falling tests. In this embodiment, the top pack serving as a cover is illustrated as transparent and permits a view of the fronts or backs of the top layer of stacked liquid crystal cells. This device is essentially constructed in accordance with the device shown in FIG. 3, that is to say all the cells 1 in a pack lie in a horizontal plane and all the cells 1 of different packs, which lie in the corresponding depressions in each pack, are disposed one above the other. Transparent substances such as hard PVC or translucent materials such as polystyrene are preferably used as a material for the packs because these materials permit a visual check of the fronts or backs of the cells, but other plastic materials as well as cardboard, metal or any other substance can be used, the important thing being that these substances can be given the required shape with a substantially uniform thickness of the material of preferably a few tenths of a millimeter in thickness, for example by pressing in a tool. Each cell lies against the surfaces $F_{11}$, $F_{12}$, $F_{13}$ and $F_{14}$, or a depression, which are illustrated hatched and which are chamfered at an angle of about 20° to the horizontal from the top outside towards the bottom inside. The angle of chamfer can be smaller or greater depending on the dimensions of the cells 1 to be packed but the normal projection of each of the surfaces $F_{11}$, $F_{12}$, $F_{13}$ and $F_{14}$ should face in the direction of the cell above. Offset downwards between these surfaces, four further surfaces $F_{21}$, $F_{22}$, $F_{23}$ and $F_{24}$ are provided which are chamfered at an angle of about −20° to the horizontal and which are chamfered from the top inside towards the bottom outside so that these surfaces only rest on the edges K of the subjacent liquid crystal cells. With these surfaces, too, the angle of chamfer can be smaller or greater but the normal projection of each of the surfaces $F_{21}$, $F_{22}$, $F_{23}$ and $F_{24}$ should point in the direction of the subjacent cells. By means of the surfaces $F_{21}$, $F_{22}$, $F_{23}$ and $F_{24}$ of the upper pack and the surfaces $F_{11}$, $F_{12}$, $F_{13}$ and $F_{14}$ of the lower pack, all the cells in between are held at all the edges K bounding the fronts and backs so that slipping of the cells is prevented and at the same time contact between the sensitive fronts and backs thereof and packing material is avoided.

In the region of each depression, at all four sides of the cells, apertures 9, 9', and 9'' are provided by means of which the removal of the cells 1 is rendered possible for the purpose of mounting these cells in indicating instruments.

The surfaces $F_{11}$, $F_{12}$, $F_{13}$ and $F_{14}$ of the upper region $Z_1$ are bounded at the outside by projecting boss members $N_{11}$, $N_{12}$, $N_{13}$ and $N_{14}$, that is to say emerging upwards from the plane of the drawing. As a result, the effect is achieved that the cells 1 remain non-displaceably in position upon shaking movements of the pack, even after removal of the cover. The same applies to the cells disposed on a pack turned upside-down because the surfaces $F_{21}$, $F_{22}$, $F_{23}$ and $F_{24}$ are bounded at the outside by projecting boss members which close the apertures 9, 9', 9'' and 9''' at the bottom in FIG. 4.

Apart from liquid crystal cells, other articles provided with edges and/or corners and the surfaces of which have to be protected from mechanical effects, can naturally be packed in the device according to the invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for packing rectangular liquid crystal cells, comprising:

at least two identical stackable plastic packs, each pack comprising, first means for immobilizing said cells upon stacking said packs, said means comprising a plurality of depressions, each depression provided to receive one of said cells, each depression having at least two first opposite surfaces which are inclined from the top outside towards the bottom inside and which are provided in an upper region of said pack and having at least two second opposite surfaces which are inclined from the top inside towards the bottom outside and which are provided in a lower region of said pack, whereby said first and second surfaces are arranged in such a manner that the edges of said cells are clamped between said second surfaces of an upper pack and said first surfaces of a lower pack, second means for preventing displacement of said cells upon shaking movements of the device after removal of said upper pack, and third means for facilitating removal of said cells from a lower pack after separation of said upper pack therefrom.

2. A device according to claim 1, wherein said first and second surfaces of said first means are vertically offset from another, said second means comprises upwardly projecting boss members bounding said first surfaces, and said third means comprises apertures arranged between two contiguous of said depressions.

3. A device according to claim 2, further comprising:

each of said upwardly projecting boss members immobilizing four corners of four different cells, and said apertures arranged between two contiguous upwardly projecting boss members.

4. A device according to claim 3 in which said second means comprises:

downwardly projecting boss members bounding said second surfaces and immobilizing two edges of two different cells after turning the device upsidedown.

* * * * *